US005799526A

United States Patent [19]

Mieze et al.

[11] Patent Number: 5,799,526

[45] Date of Patent: Sep. 1, 1998

[54] PROCESS AND PLANT FOR COLD ROLLING WITH COMPENSATION FOR OVALIZATION OF THE ROLLING ROLLS

[75] Inventors: Regis Mieze, Grand Fort Philippe; Gérard Robert, Bollezeele; Daniel Piquet, Ruminghem; Christophe Silvy Leligois, Metz; Michel Abikaram, Courbevoie, all of France

[73] Assignee: Clecim, Cergy Pontoise Cedex, France

[21] Appl. No.: 661,156

[22] Filed: Jun. 10, 1996

[30] Foreign Application Priority Data

Jun. 8, 1995 [FR] France ..... 95 06747

[51] Int. Cl.[6] ..... B21B 31/07; B21B 31/24; B21B 37/00; B21B 37/12

[52] U.S. Cl. ..... 72/248; 72/240; 72/11.4; 72/12.3; 72/8.6

[58] Field of Search ..... 72/8.6, 8.7, 11.4, 72/12.3, 205, 240, 248, 10.3, 11.1, 8.3

[56] References Cited

U.S. PATENT DOCUMENTS

| | | | |
|---|---|---|---|
| 3,848,443 | 11/1974 | Peterson et al. | 72/8.6 |
| 4,656,854 | 4/1987 | Stewart et al. | 72/205 |
| 5,103,662 | 4/1992 | Fapiano | 72/205 |

FOREIGN PATENT DOCUMENTS

| | | |
|---|---|---|
| 0 435 595 A2 | 7/1991 | European Pat. Off. . |
| 2 392 737 | 6/1978 | France . |
| 2166569 | 5/1996 | United Kingdom . |

OTHER PUBLICATIONS

Patent Abstracts of Japan, vol. 11, No. 21, (M-555), Jan. 21, 1987.

Patent Abstracts of Japan, vol. 9, No. 121, (M-382), May 25, 1985.

*Primary Examiner*—Lowell A. Larson
*Assistant Examiner*—Rodney Butler
*Attorney, Agent, or Firm*—Oblon, Spivak, McClelland, Maier & Neustadt, P.C.

[57] ABSTRACT

A process for the cold rolling of a metal strip between rollers of rolling stands arranged sequentially is provided, along with a plant for its implementation, wherein the process involves:

analyzing, as a function of frequency, a signal from an inter-stand tension measurement sensor corresponding to a level of tension of the metal strip to determine periodic variations in the signal having frequencies corresponding to a speed of rotation of the pair of rollers in a downstream rolling stand and proportional to out-of-roundness defects present in the rollers of the downstream rolling stand; and compensating for the out-of-roundness defects in the rollers in the downstream rolling stand by adjusting the clamping setting of the rollers in the downstream rolling stand in accordance with a compensation signal, produced by the means for compensating, that is proportional to the periodic variations.

6 Claims, 3 Drawing Sheets

PROCESS AND PLANT FOR COLD ROLLING WITH COMPENSATION FOR OVALIZATION OF THE ROLLING ROLLS

BACKGROUND OF THE INVENTION

1. Field of the Invention

The present invention relates to a process and a plant for rolling thin sheet metal, especially steel sheets.

2. Discussion of the Background

For the production of a sheet-metal strip by rolling, a great deal of attention is generally paid to thickness uniformity, especially along the strip or in the rolling direction. This thickness uniformity is even more critical when thin metal sheets are produced, especially metal sheets for packaging and/or for drink cans.

The strips are generally rolled in plants having a succession of rolling stands, with the strips running in the gap after each stand, delimited by the rolling cylindrical rollers or cylinders (For the purpose of the present invention, the rolling cylinders are hereafter referred to as rollers).

Conventionally, rolling is carried out by controlling various parameters of each stand, especially on the basis of the tension between the stands and/or the clamping of the strip to be rolled between two working rollers of a stand.

Thus, referring to FIG. 1, a conventional rolling plant having three rolling stands C1, C2 and C3 may be controlled by a control device S. The control device S, works based on measurement of the inter-stand tension in the strip B by sensors T2 and T3 and/or by acting on the successive clamping means of each stand A1, A2 and A3.

Strict circularity of the rollers is one prerequisite for obtaining a constant thickness over the length of the strip. However, the methods of machining the cylindrical rollers do not enable a perfectly circular shape to be attained and the rollers often have a slight ovalization.

Furthermore, even when grinding does enable a circular shape to be attained, a slight ovalization may still occur or be accentuated on the rollers in service, due to the effect of external forces, such as thermal stresses.

This slight ovalization of the rollers, also called "out-of-roundness" or "eccentricity", is manifested, for example, by variations, during rolling, of a few tens of micrometers in the gap between two working rollers of a rolling stand.

The variations in the thickness of the gap are periodic, and have a frequency proportional to the speed of rotation of the rolls. This causes periodic variations in thickness along the sheet-metal strip leaving each rolling stand. Such variations in thickness of the strip are called out-of-roundness defects or eccentricity defects. These thickness variations are typically about 0.5 μm for each rolling stand in a plant, representing a variation of 0.2% on a 0.25 mm thick strip.

Such a thickness variation in a metal strip is unacceptable for most uses, especially in the field of packaging and drink cans.

There are some known processes for compensating for this ovalization or "out-of-roundness" of the rollers during rolling and for obtaining a more uniform thickness along the strip.

In one conventional process, prior to rolling a strip, the rolling stands of the plant are rotated "empty", with the working rollers in a clamped setting. The "out-of-roundness" defect is logged by measuring, in terms of amplitude and phase, the variations in force between the rollers and then, during rolling of a strip, an out-of-roundness compensation signal having the same amplitude as the previously measured defect, but in phase opposition thereto, is applied to the clamping setting for the rollers of each stand.

Such an out-of-roundness compensation process is an off-line compensation process which is not effective when the out-of-roundness defect is not constant. This is especially the case when the defect varies during rolling, such as when it is due to the effect of distortions of the rollers resulting from thermal stresses.

A second, real-time, out-of-roundness compensation process is known in which, during rolling, the thickness of the strip leaving each stand is measured, and the periodic variations in the thickness that correspond to the rotation frequencies of the rollers and that have a constant phase shift with it, are logged. The amplitude and phase of the signal to be applied to the clamping setting in order to compensate for the out-of-roundness is then calculated from this data.

For this purpose, referring to FIG. 2, an out-of-roundness compensation device is attached to the plant described previously and comprises thickness sensors E1 and E2 arranged downstream of the rolling stands, sensors V1 and V2 for detecting the angular position of the rollers, and compensators P1 and P2.

From the signals supplied by the sensors E1 and V1 for P1 and E2, and V2 for P2, the compensators P1 and P2 evaluate the clamping setting compensation signal to be applied to the means A1 and A2 for clamping the stands C1 and C2, in order to eliminate the out-of-roundness defects of the rollers.

Such a real-time out-of-roundness compensation process therefore requires the installation of many measurement sensors on each stand.

The thickness measurement sensor is always offset by a few meters, for example 2.5 m, after the gap exit of a stand, which causes a delay in logging the out-of-roundness defects of the rollers of the rolling stand with respect to the creation of the defect itself within the gap of the stand.

Thus, the delay in detecting the defect may be about 0.5 s for a stand/sensor distance of 2.5 m and a running speed of the strip in the stand of 300 m/min.

Moreover, there is considerable noise in the thickness measurement signal supplied by the sensors E1 and E2 and it is often difficult to discriminate between the periodic thickness variations in the sheet relating to the out-of-roundness defects of the rollers compared to thickness variations of other origins.

In order to evaluate the compensation signal to be applied to the clamping means A1 and A2 by the compensators P1 and P2, the thickness measurement signal is analyzed as a function of frequency, such as by a Fourier transform. The signals that correspond to the frequency of rotation of the rollers of the stands C1 and C2 are extracted from the spectrum obtained and a compensation signal is generated from these extracted signals.

In order to produce a reliable and accurate compensation signal, so that the signals extracted from the thickness measurement really do represent out-of-roundness defects and not other phenomena, it is necessary to extend the Fourier transform integration time, which improves the frequency resolution of the analysis of the measurement signal, in order to make it easier to extract the out-of-roundness signals from the measurement signal, and avoid or limit random or inaccurate defect detections.

However, extending the integration time further increases the delay in detecting the out-of-roundness defect with respect to the instant at which the defect itself was created.

This long integration time is necessary in order to obtain a stable regulation of the operation of the out-of-roundness compensation device. Thus, for the regulation of the compensation device, there results an overall response time, between the creation of an out-of-roundness defect on a stand and the complete compensation for the defect, which is much too long, and during which time the thickness defects of a running strip are not properly corrected.

By way of example, the response times of the components of the conventional compensation device may be:

typical response time of a thickness measurement sensor: 50 ms;

delay due to the stand/sensor distance: 500 ms;

response time of the clamping means: 50 to 70 ms.

With such a device, the out-of-roundness compensation control loop will have a response time of about several tenths of a second.

If the running speed is high, and since the strip obviously passes through several rolling stands, at the end of rolling the portions of strip along which the out-of-roundness defects persist represent a major part of the strip (up to one half). This no longer makes it possible to provide the guarantee required for a commercially viable product, such as the guarantee of a thickness variation of 2.5–3.0% or less.

Thus, the conventional real-time out-of-roundness compensation process does not yet have the required performance to provide a guarantee that the thickness is sufficiently uniform over an entire rolled strip, especially in the case of the rolling of thin metal sheets.

Moreover, this compensation process requires expensive equipment, particularly due to the high number of sensors to be installed.

SUMMARY OF THE INVENTION

Accordingly, one object of the present invention is to provide a rolling process which enables a metal strip to be rolled with a very high thickness uniformity along the entire strip.

A further object of the present invention is to provide a reliable and economic device for implementing the process.

These and other objects of the present invention have been satisfied by the discovery of a process for the cold rolling of a metal strip, comprising:

providing two or more rolling stands arranged sequentially, each of said rolling stands comprising a pair of rollers arranged such that a metal strip passes between said pair of rollers, wherein an inter-stand tension measurement sensor is located between at least one pair of said two or more rolling stands, with one rolling stand of said pair upstream of said tension sensor and one rolling stand of said pair downstream of said tension sensor and said tension sensor is coupled to a means for compensating for out-of-roundness defects in said pair of rollers in the downstream roller stand, wherein said means for compensating for out-of-roundness defects is further coupled to a clamping means for adjusting a clamping setting of said pair of rollers in said downstream rolling stand;

analyzing, as a function of frequency, a signal from said inter-stand tension measurement sensor corresponding to a level of tension of said metal strip to determine periodic variations in said signal having frequencies corresponding to a speed of rotation of said pair of rollers in said downstream rolling stand and proportional to out-of-roundness defects present in said rollers of said downstream rolling stand; and compensating for said out-of-roundness defects in said rollers in said downstream rolling stand by adjusting said clamping setting of said rollers in said downstream rolling stand in accordance with a compensation signal, produced by said means for compensating, that is proportional to said periodic variations.

BRIEF DESCRIPTION OF THE FIGURES

A more complete appreciation of the invention and many of the attendant advantages thereof will be readily obtained as the same becomes better understood by reference to the following detailed description when considered in connection with the accompanying figures, wherein.

DETAILED DESCRIPTION OF THE PREFERRED EMBODIMENTS

The present invention relates to a process for the cold rolling of a strip between the rollers of rolling stands arranged sequentially (one after the other). In the process a real-time modification is made to the roll clamping setting of at least one of the rolling stands in order to compensate for the out-of-roundness defects of the rollers of the that rolling stand. The modification is evaluated by analyzing, as a function of frequency, a signal corresponding to the measurement of a rolling parameter specific to the rolling stand and by extracting from the measurement signal the periodic variations in the signal. The frequencies of these periodic variations correspond to the speeds of rotation of the rollers. From these periodic variations is obtained a compensation signal proportional to the periodic variations and that is applied to the rolling stand. The measurement signal is obtained by a measurement of the tension in the strip immediately upstream of the rolling stand.

The present invention also relates to a rolling plant comprising a succession of rolling stands, inter-stand tension measurement sensors, clamping means for each stand, a control device, especially for controlling the clamping means, and at least one means for compensating for out-of-roundness defects of the rolling rollers of one of the rolling stands that is connected to the means for clamping the rolling stand, in order to deliver an out-of-roundness defect compensation signal to the rollers. The compensation device is also connected to an inter-stand tension measurement sensor located immediately upstream of the rolling stand in order to receive the measurement signal from the one or more tension measurement sensors (T2 and T3) and determine the compensation signal.

Figure 3:
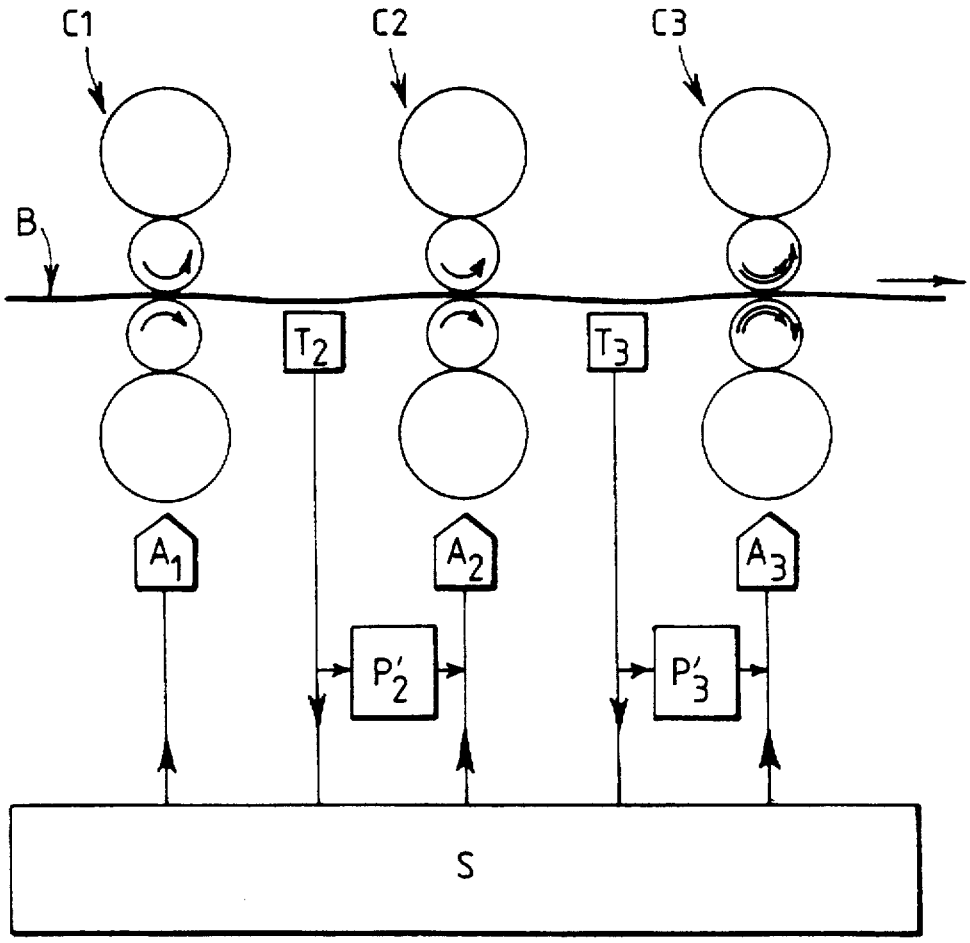
FIG. 3 represents the same rolling plant as in FIG. 1, but provide with a device for compensating for out-of-roundness of the rollers according to the present invention.

Referring to FIG. 3, an exemplary embodiment of the rolling plant of the present invention is provided. This embodiment comprises three rolling stands C1, C2 and C3, a control device S, inter-stand tension measurement sensors T2 and T3, means A1, A2 and A3 for clamping the stands C1, C2 and C3, respectively, and compensation devices P'2 and P'3.

Measurement of the inter-stand tension corresponds to the tension in the strip between each stand. Suitable sensors T2 and T3 provided for this purpose include deflection-type tensiometers.

The clamping means A1 and A2, A3 are primarily controlled by a setting delivered by the control device S.

The function of the compensation devices P'2 and P'3, as previously for the compensators P2 and P3, is to evaluate the compensation signal intended for correcting, in real time, the clamping setting of the means A2 and A3 for clamping the stands C2 and C3 for the purpose of eliminating the out-of-roundness defect of the rollers of the stands.

In order to evaluate the compensation signal, according to the invention, the compensation devices P2 and P3 are connected to the tension sensors T2 and T3.

Conventionally, the rolling rollers of the stands C2 and C3 are ground but normally have ovalization or out-of-roundness defects which, during rolling without compensation, would cause variations in the gap between the working rollers.

In a conventional manner, a strip B is rolled by controlling the operation of the stands C1, C2 and C3 of the plant with the aid of the control device S, especially on the basis of the measurement of the inter-stand tension in the strip B by the sensors T2 and T3 and by acting on the successive means A1, A2 and A3 for clamping each stand.

Furthermore, for the purpose of rolling the metal strip B while maintaining the thickness variations along the strip within a range that is appreciably less than the ovalization defects of the rollers of the stands C2 and C3, a signal for compensating for the out-of-roundness of the said rollers is applied to the clamping setting of the clamping means A2 and A3.

According to the invention, the compensators P'2 and P'3 deliver the compensation signal to the clamping means A2 and A3, respectively, by evaluating the signal on the basis of the measurement signal delivered by the sensors T2 and T3 upstream of the stands C2 and C3.

The invention is therefore applicable after the second stand of the rolling plant and as far as the final stand without installing additional sensors, since tension measurement sensors T2, T3 are already conventionally installed between each stand in order to allow the device S to control the rolling plant conventionally.

For example, the compensation device P'2 is designed, in a manner known per se, to extract from the signal from the sensor T2 the periodic variations in the tension in the strip B upstream of the stand C2 which have a frequency equal to the speed of rotation of the rollers of the stand C2 and to generate a compensation signal proportional to these extracted variations.

According to one alternative embodiment of the invention, the compensation device P'2 also takes into account the harmonics in the out-of-roundness defects, that is to say the periodic variations in the tension in the strip B which have a frequency which is a multiple of the speed of rotation of the rollers of the stand C2.

In order to extract these periodic variations, a Fourier transform is generally carried out.

According to the present invention, the tension measurement signal can be integrated over a much shorter time than in the processes of the prior art while at the same time detecting the out-of-roundness defects of the rollers of the stand C2 reliably and accurately.

Figure 1:
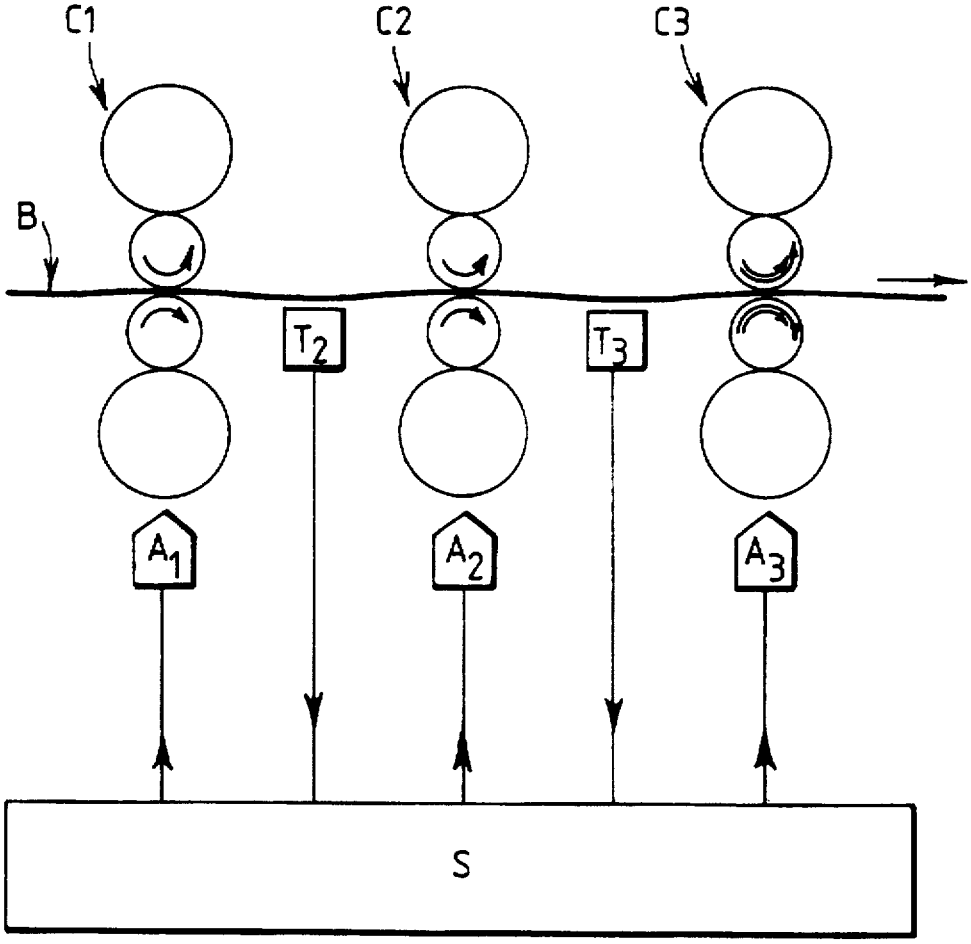
FIG. 1 is a schematic diagram of a conventional cold-rolling plant with its control device.
Figure 2:
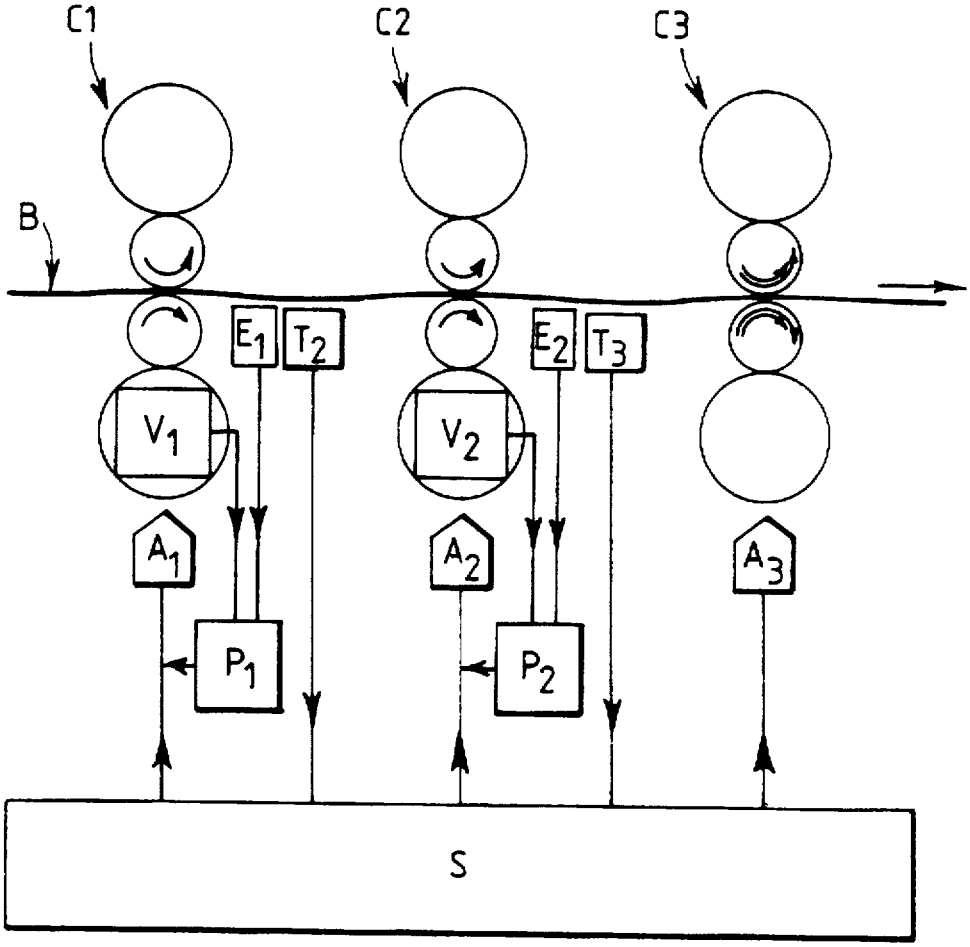
FIG. 2 represents the same rolling plant as in FIG. 1, provided with a conventional device for compensating for out-of-roundness of the rollers.

Although the two working rollers of the stand C2 may have slightly different speeds of rotation, especially because of slight differences in diameter, it is not necessary to choose a sufficiently long integration time to enable the out-of-roundness defect of one of the rollers to be discriminated from that of the other and it proves to be sufficient to evaluate the compensation signal on the basis of the average amplitude of the defect measured. Surprisingly, it was observed that there is much less noise on the out-of-roundness defect detection signal when it comes from the tension measurement of a sensor T2 upstream of the stand C2 than when it comes especially from the thickness measurement of a sensor E2 downstream of the stand C2, as in the process of the prior art shown in FIG. 2.

Thus, in order to log the out-of-roundness defects of the rollers of one stand, by analyzing the frequencies of the measurement signal delivered by a tension sensor upstream of the stand, a very fine frequency resolution is no longer necessary for reliable and accurate detection of the out-of-roundness defect, which enables the Fourier transform integration times to be substantially decreased.

Thus, according to the present invention, since the out-of-roundness defect sensor is a tension sensor, there is no delay between the appearance of a defect and its detection, contrary to the process of the prior art.

The present compensation devices allow for the analysis of the measurement signals, as a function of frequency, with integration times much shorter than in the prior art.

Overall therefore, the response time of the out-of-round compensation device according to the present invention is considerably shortened compared to the devices of the prior art.

For example, for rollers rotating at 60 revolutions per minute, i.e. 1 Hz, a tension measurement sensor having a response time of 16 ms, and clamping means having a response time to application of a setting of 70 ms, the overall response time of the out-of-roundness compensation control according to the process of the present invention is only approximately 2.5 revolutions of a roll, i.e. approximately 2.5 seconds.

The response time of the clamping means and the maximum rate of clamping of these means may be limiting and critical factors for implementing the process according to the invention; preferably, the response time of the clamping means must remain less than the time for one revolution of the rollers.

Since the speed of the strip, and therefore the speed of rotation of the rollers, increases from the upstream end to the downstream end of a rolling plant, these conditions may be fulfilled only for the first stands of the plant and it is not always possible to equip rolling plants fully with the compensation device according to the invention.

The compensation device and its operation which are described for rolling stand 2 are also applicable to rolling stand 3, or to any other downstream stands.

According to the invention, and when all the rolling stands of a plant are equipped with the device according to the invention, metal strips are obtained at the end of rolling which have longitudinal thickness variations of less than 5 μm, less than 0.7% for an average thickness of 0.26 mm.

This application is based on French Patent Application 95 06747, filed with the French Patent Office on Jun. 8, 1995, the entire contents of which are hereby incorporated by reference.

Obviously, additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for the cold rolling of a metal strip, comprising:

providing two or more rolling stands arranged sequentially, each of said rolling stands comprising a pair of rollers arranged such that a metal strip passes between said pair of rollers, providing continuously during the cold rolling of the strip, a means for compensating for out-of-roundness defects in a pair of rollers of a stand, coupled to a clamping means of said rolling stand, with a signal of measurement of a tension in the strip immediately upstream of the said stand, extracting from said signal, periodic variations having a frequency corresponding to the speed of rotation of the said rollers of the said stand, elaborating from said periodic variations a compensation signal having a frequency which corresponds to the speed of rotation of the said rollers and in phase opposition to the periodic variations, compensating in real time for said out-of-roundness defects in said rollers of said rolling stand by adjusting said clamping means of said rollers in accordance with the compensation signal.

2. A process according to claim 1, further comprising:

elaborating from said periodic variations a compensation signal having a frequency which is a multiple of the speed of rotation of the said rollers.

3. A rolling plant comprising:

a first and a second rolling stand, each said stand comprising a pair of rollers arranged such that a metal strip can pass between said pair of rollers;

a first and a second clamping means respectively coupled to said first and second rolling stands;

at least one tension measurement sensor, wherein at least a first said sensor is provided downstream from said first rolling stand and upstream from said second rolling stand, said sensor providing a tension measurement signal;

at least one compensation means for compensating out-of-roundness defects of said rollers, at least a first said compensation means coupled to said first sensor;

a control device for controlling at least said second clamping means, said control device coupled to at least said first compensating means, said control device coupled to at least said second clamping means;

wherein when said first sensor detects a tension in said metal strip, said sensor continuously providing said measurement signal corresponding to said tension to said compensation means;

wherein said compensation means continuously extracts from said measurement signal, periodic variations having frequency corresponding to the speed of rotation of said rollers, said compensation means elaborating from said periodic variations, a compensation signal having a frequency corresponding to the speed of rotation of said rollers and in phase opposition to said periodic variations, said compensating means continuously providing said compensating signal to said control device;

wherein said control device provides a clamping signal to said second clamping means, according to said compensation signal, thereby adjusting a clamping setting in said pair of rollers in said second rolling stand and compensating for out-of-roundness defects of said rollers in real time.

4. The plant according to claim 3, wherein said tension measurement sensor is a deflector-type tensiometer.

5. The plant according to claim 3, wherein there are three or more sequentially arranged rolling stands, and wherein each sequentially arranged pair of said rolling stands comprises a first upstream stand and a second downstream stand, said tension measurement sensor, said means for compensating for out-of-roundness defects in said pair of rollers in said downstream rolling stand and said clamping means, wherein said controller is a single unit controlling all of said clamping means provided for each said pair of said stands.

6. The plant according to claim 3, wherein each said clamping means has a response time for reacting to said signal from said tension measurement sensor of less than a time required for a single revolution of a roller in said pair of rollers of said second rolling stand.

* * * * *